US005666774A

United States Patent [19]

Commins

[11] Patent Number: 5,666,774

[45] Date of Patent: Sep. 16, 1997

[54] ADJUSTABLE SUPPORT SYSTEM

[75] Inventor: Alfred D. Commins, Danville, Calif.

[73] Assignee: Simpson Strong-Tie Company, Inc., Pleasanton, Calif.

[21] Appl. No.: 497,258

[22] Filed: Jun. 30, 1995

[51] Int. Cl.[6] ..... E04B 1/38

[52] U.S. Cl. ..... 52/298; 52/126.4; 52/295; 52/296; 248/188.4

[58] Field of Search ..... 52/295, 296, 298, 52/698, 126.1, 126.4, 126.7; 248/188.4, 545, 650, 680; 403/296, 306, 307, 308

[56] References Cited

U.S. PATENT DOCUMENTS

| | | | |
|---|---|---|---|
| 1,335,617 | 3/1920 | Solomon | 52/296 |
| 1,445,938 | 2/1923 | Farrington | 52/295 |
| 1,592,681 | 7/1926 | Grothe . | |
| 2,227,713 | 1/1941 | Higgins . | |
| 3,027,140 | 3/1962 | Holzbach . | |
| 3,286,972 | 11/1966 | Jackson . | |
| 3,411,252 | 11/1968 | Boyle, Jr. | 52/295 |
| 3,429,092 | 2/1969 | Perry . | |
| 3,831,329 | 8/1974 | Lear . | |
| 3,921,356 | 11/1975 | Hughes . | |
| 4,096,677 | 6/1978 | Gilb . | |
| 4,387,543 | 6/1983 | Tschan . | |
| 4,614,070 | 9/1986 | Idland . | |
| 4,958,470 | 9/1990 | Han . | |
| 5,561,950 | 10/1996 | Collins . | |

FOREIGN PATENT DOCUMENTS

| | | |
|---|---|---|
| 94053 | 6/1959 | Norway . |
| 1260281 | 1/1972 | United Kingdom . |

OTHER PUBLICATIONS

Simpson Strong-Tie Co., Inc. catalog p. 7 copyright 1978.

*Primary Examiner*—Michael Safavi
*Attorney, Agent, or Firm*—James R. Cypher

[57] ABSTRACT

An adjustable support system for joining structural members which includes a sheet metal base member formed with a drawn and threaded opening for threadably receiving an elongated support member threaded at one end for threadably engaging the threaded opening in the sheet metal base member. In one form of the invention both support members have openings for the receipt of the elongated support member. In another form of the invention, only one of the support members has an opening and adjustment is accomplished by providing another threaded portion on the support member which then threadably engages an adjustment nut.

6 Claims, 4 Drawing Sheets

ADJUSTABLE SUPPORT SYSTEM

BACKGROUND OF THE INVENTION

Wood posts cannot be set directly on concrete because, in time, water will get on the concrete floor and cycles of wet and dry will rot the wood post. It is essential therefor to elevate the lower end of the wood post above the concrete floor. Preferably, the wood post should be attached to the concrete floor or foundation so that it will not be dislocated horizontally. Where the structure is subject to earthquake or high wind loads, the post should also be attached to the floor to prevent the post from moving upwardly. Because of the difficulty in setting post anchors to an exact height above the concrete surface and then cutting posts to an exact length, several attempts have been made to provide for adjustment of the height of the post anchor after the concrete has set. All of the prior art systems have proven to be either too expensive to construct or too expensive to install.

Jacking systems as taught by Holzbach U.S. Pat. No. 3,027,140 and Lear U.S. Pat. No. 3,831,329 are far too expensive. In housing projects where thousands of adjustable members might be used, even a few extra metal pieces or one or two welds can prove to be too expensive to contractors who are attempting to carefully cost out a project. Even when a do it yourselfer is building a single car port, an expensive jack would prove to expensive to the home owner who must be extremely careful in the expenditure of funds.

Machined and welded support members as taught by British Patent 1,260,281 granted to Robinson and U.S. Pat. No. 4,614,070 granted to Idland are far too expensive to compete in today's competitive markets.

SUMMARY OF THE INVENTION

The adjustable support system of the present invention consists, in its most basic form, of only two parts; a U-shaped base member and a threaded rod. The U-shaped base member is formed with a threaded opening by drawing and threading the metal in the base member itself.

The primary object of the present invention is to provide an adjustable support at the very least manufacturing cost which will provide the necessary support.

Another object is to provide an adjustable support system which has a minimum number of parts and is easy to install.

A further object is to provide an adjustable support system which requires no welding or machining of parts.

A still further object is to provide an adjustable support system which requires no painting.

Another object is to provide an adjustable support system which will provide uplift resistance where the structure is subject to earthquakes or high winds.

BRIEF DESCRIPTION OF THE INVENTION

Figure 1:
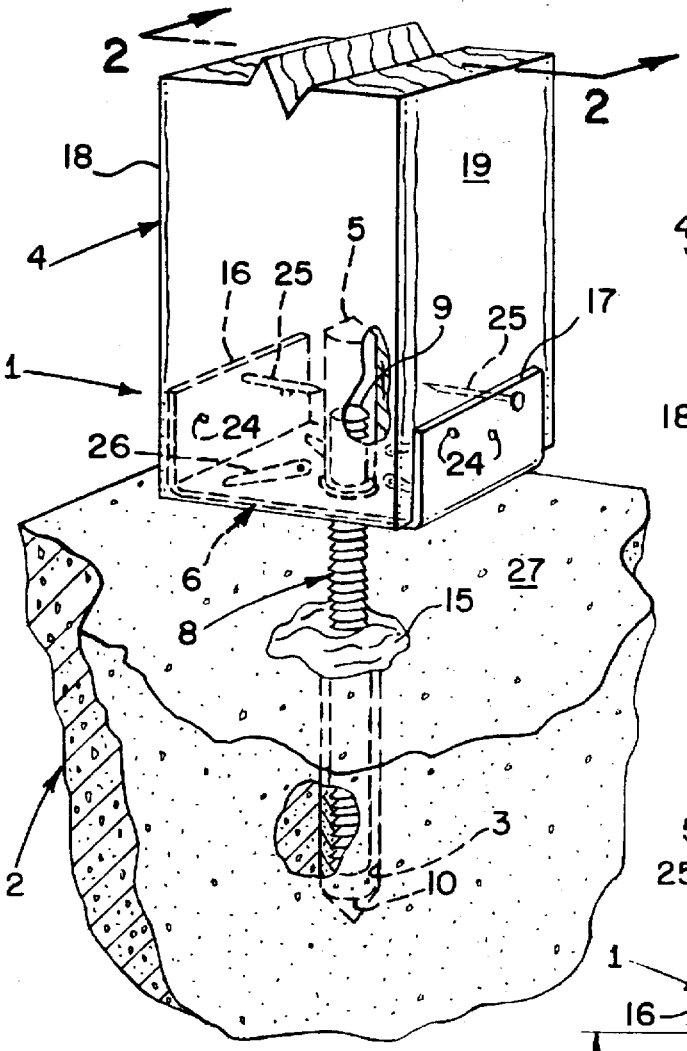
FIG. 1 is a perspective view of the preferred form of the invention supporting a wood post and anchored to a concrete foundation.

The adjustable support system 1 of the present invention includes: a first structural member 2 formed with an opening 3 therein; a second structural member 4 spaced from the first structural member 2 and having one form of the invention formed with an opening 5 therein; a sheet metal base member 6 positioned for engagement with at least one of the first and second structural members 2 and 4 and formed with a drawn and threaded opening 7 therethrough; and an elongated support member 8 for adjusting the distance between the first and second structural members 2 and 4 threaded at a first end 9 for threadable engagement with the threaded opening 7 in the sheet metal base member 6 and having a second end 10 positioned in alignment with the opening 3 in the first structural member 2.

Where uplift resistance is required, the adjustable support system 1 includes: securing means 15 joining the elongated support member 8 to the first structural member 2, the securing means 15 may be cement grout poured into opening 3, but preferably it is a two component epoxy material which is readily commercially available from Simpson Strong-Tie Company, Inc. and others.

The adjustable support system 1 of the present invention may be used where both structural members are concrete or both are wood, but in most commercial applications the first structural member 2 is formed from concrete; and the second structural member 4 is formed from wood. Generally the first structural member 2 is a concrete foundation, a concrete slab floor or a truncated pier block which is generally set on rock or compacted ground. The second structural member 4, on the other hand is usually a post having a nominal 4×4 or 4×6 size.

The adjustable support system 1 of the present invention is most often used with a sheet metal base member 6 which includes a pair of flanges 16 and 17 positioned for engaging the sides 18 and 19 of the second structural member 4.

Figure 3:
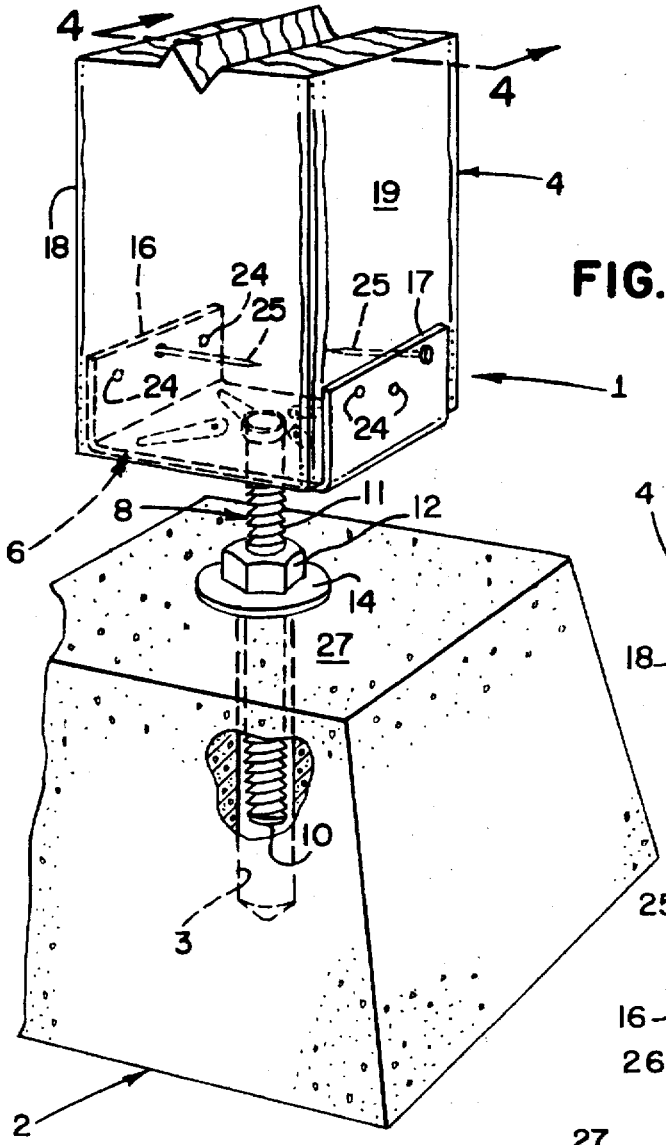
FIG. 3 is a perspective view of another form of the invention supporting a wood post and set in a concrete pier block. Portions of the pier block are cut away to illustrate the relationship of the support member to the pier block.
Figure 4:
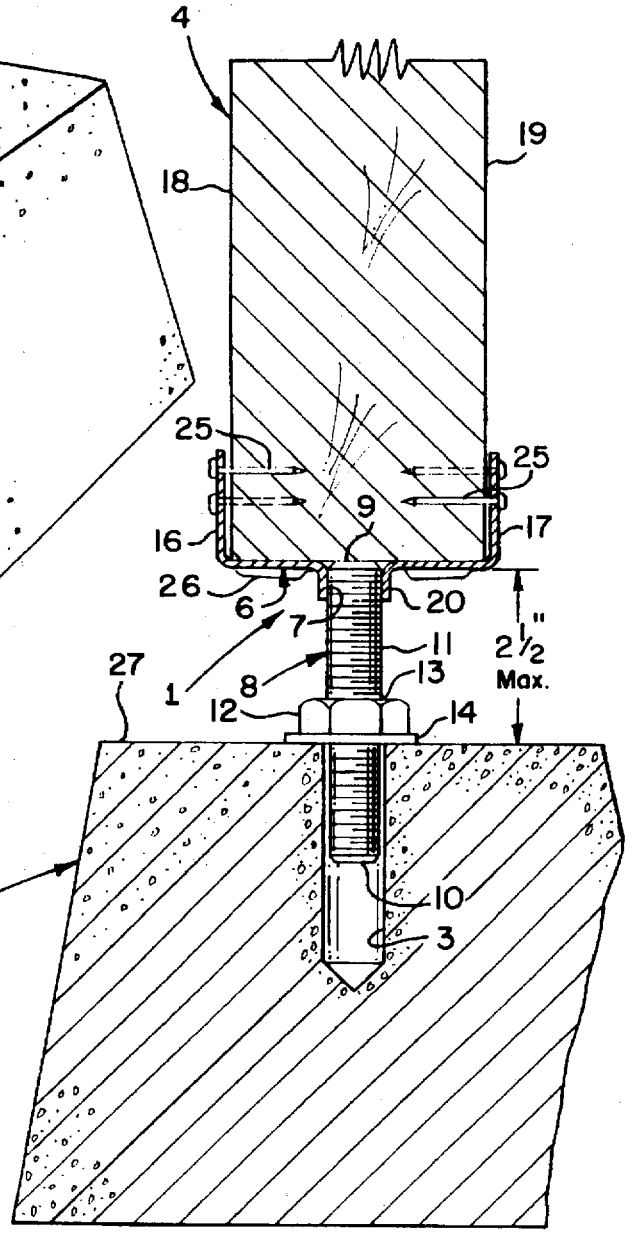
FIG. 4 is a cross sectional view of the invention illustrated in FIG. 3 taken along line 4—4.

Referring to FIGS. 3 and 4, in another form of the invention the adjustable support system of the present invention includes: a first structural member 2 formed with an opening 3 therein; a second structural member 4 spaced from the first structural member 2 and preferably having no opening formed therein; a sheet metal base member 6 positioned for engagement with the second structural member 4 and formed with a drawn and threaded opening 7 therethrough; an elongated support member 8 for adjusting the distance between the first and second structural members 2 and 4 threaded at a first end 9 for threadable engagement with the threaded opening 7 in the sheet metal base member 6, and having a threaded other portion 11 spaced from the threaded end 9 and having a second end 10 positioned in alignment with the opening 3 in the first structural member 2; and adjustment means 12 formed with a threaded opening 13 therethrough for threadable engagement with the threaded other portion 11 of the elongated support member 8 and formed with means 14 for spanning the opening 3 in the first structural member 2.

As in the previously described form of the invention, in the second form of the invention the structural elements may be both concrete or they may be both wood. Most often, however, the adjustable support system 1 will be used in applications where the first structural member 2 is formed from concrete; and the second structural member 4 is formed from wood.

The sheet metal base member may be formed with various shapes, but most commonly the adjustable support system will be used in commercial systems where the sheet metal base member 6 includes a pair of flanges 16 and 17 positioned for engaging the sides 18 and 19 of the second structural member 4.

The term "drawing" as used in this application is a process that it used in applications where the metal is too thin to form threads, yet it is desired to threadably connect a support to the metal. Although the practice of "drawing" is new in the sheet metal construction connector field, it is used in other fields. In the drawing process, a small hole is made in the base metal, and then the opening is expanded with the metal of the base member being used to form an annular protrusion 20 which has sufficient thickness to provide lateral and vertical strength while still being capable of being formed with internal threads 7 in the necked down portion to receive the threaded support member 8.

In adjustable support system 1 as illustrated in FIGS. 3 and 4, first structural member 2 is formed from concrete; and second structural member 4 is formed from wood. Adjustable support system 1 includes sheet metal base member 6 which is formed with a pair of flanges 16 and 17 positioned for engaging the sides 18 and 19 of the second structural member 4.

Figure 6:
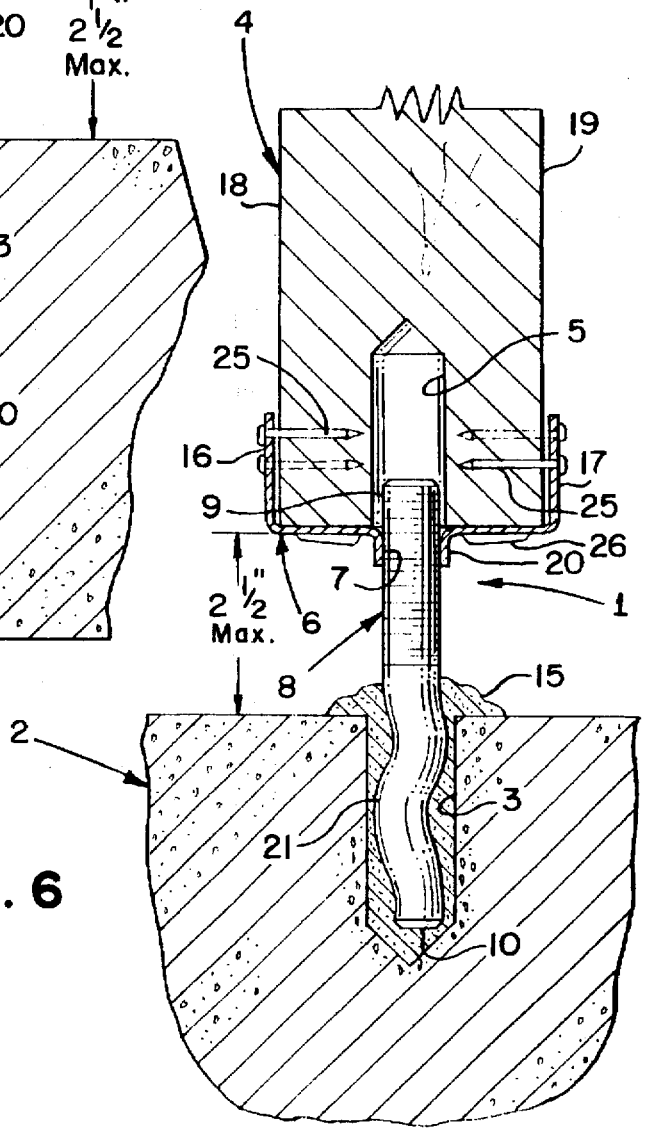
FIG. 6 is a cross section of still another form of the invention. The view is similar to FIG. 2 which was taken along line 2—2 of FIG. 1.

Referring to FIG. 6, elongated support member 8 may be deformed in section 21 as by forming a reverse curve in the metal to make it more difficult to remove the elongated member 8 from opening 3.

Figure 7:
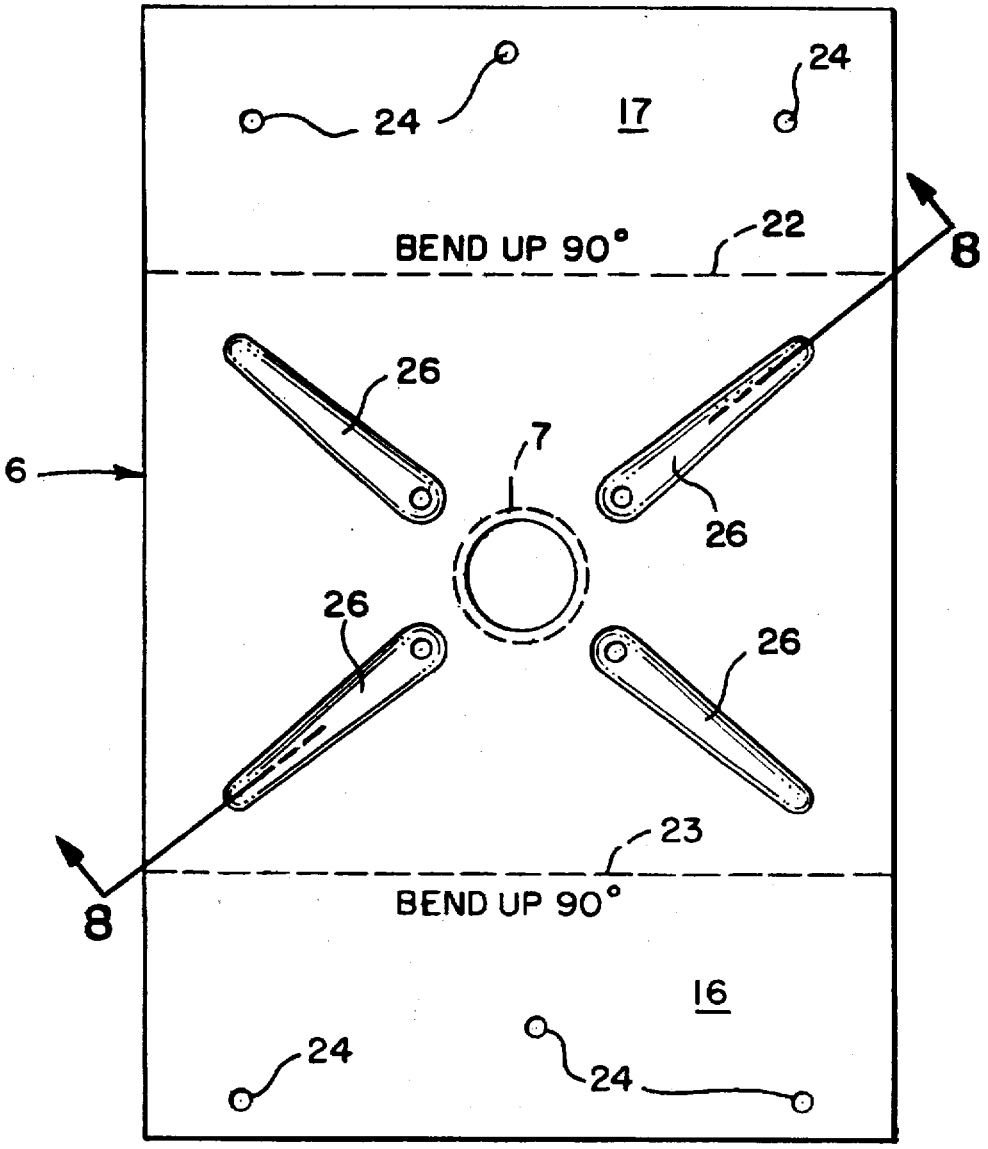
FIG. 7 is a top plan view of the unformed blank used to make the base and sides of the invention illustrated in the previous drawings.
Figure 8:
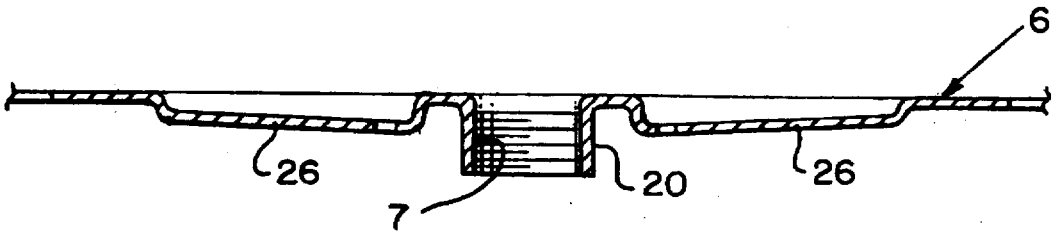
FIG. 8 is a cross sectional view of the base of the present invention after being formed and is taken along line 8—8 of FIG. 7.

Referring to FIGS. 7 and 8, sheet metal base member 6 may be made from a blank of sheet metal and bent at a 90° along bend lines 22 and 23. Openings 24 may be punched in flanges 16 and 17 for the receipt of fasteners such as nails or screws 25.

To strengthen sheet metal base member 6, embossments 26 are preferably formed in the sheet metal radiating from drawn and threaded opening 7.

OPERATION OF THE INVENTION

Figure 2:
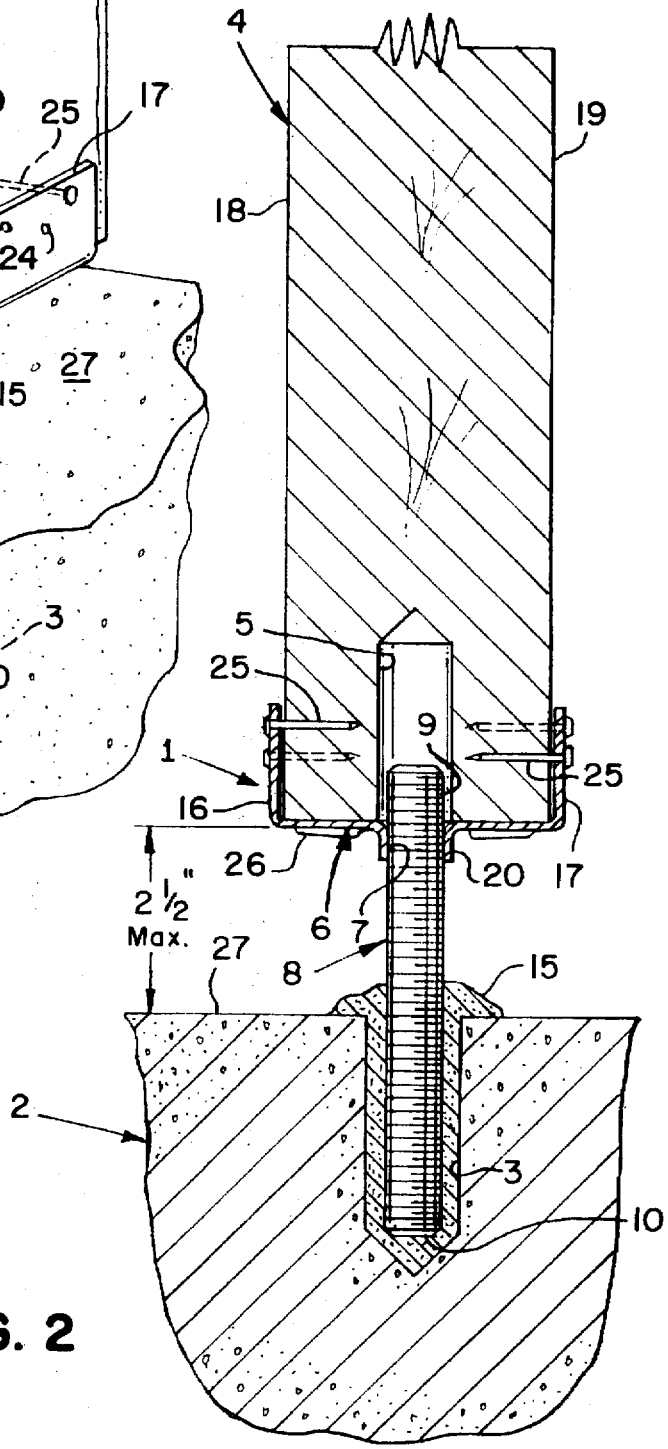
FIG. 2 is a cross sectional view of the invention illustrated in FIG. 1 taken along line 2—2.

Operation of the three forms of the invention is as follows. Referring to FIGS. 1 and 2, opening or aperture 3 is formed either by a tubular form in newly poured concrete, or by drilling an aperture in hardened concrete. Elongated support member 8 such as a threaded rod is then placed in opening 3 and fixedly attached to the concrete by securing means 15 such as by pouring grout or a two part epoxy into the opening 3. After the grout or epoxy has cured, sheet metal base member 6 is placed on elongated support member 8 by aligning first end 9 with drawn and threaded opening 7 and rotating the sheet metal base member 6 several turns. Second structural member 4 such as a wood post formed with opening 5 is lowered onto the sheet metal base member 6 so that first end 9 of elongated support member 8 is inserted into opening 5 in the post either before or after sheet metal support member 5 is rotated on elongated support member or post 8 until the proper elevation of the sheet metal base member 6 is achieved. Fasteners 25 such as nails or screws are then inserted through openings 24 in flanges 16 and 17 thereby attaching the flanges 16 and 17 to second structural member or post 4. It should be noted that in most cases, the underside 28 of sheet metal base member 6 should be spaced no more than 2 ½" above the top surface 27 of foundation or first structural member 2.

Figure 5:
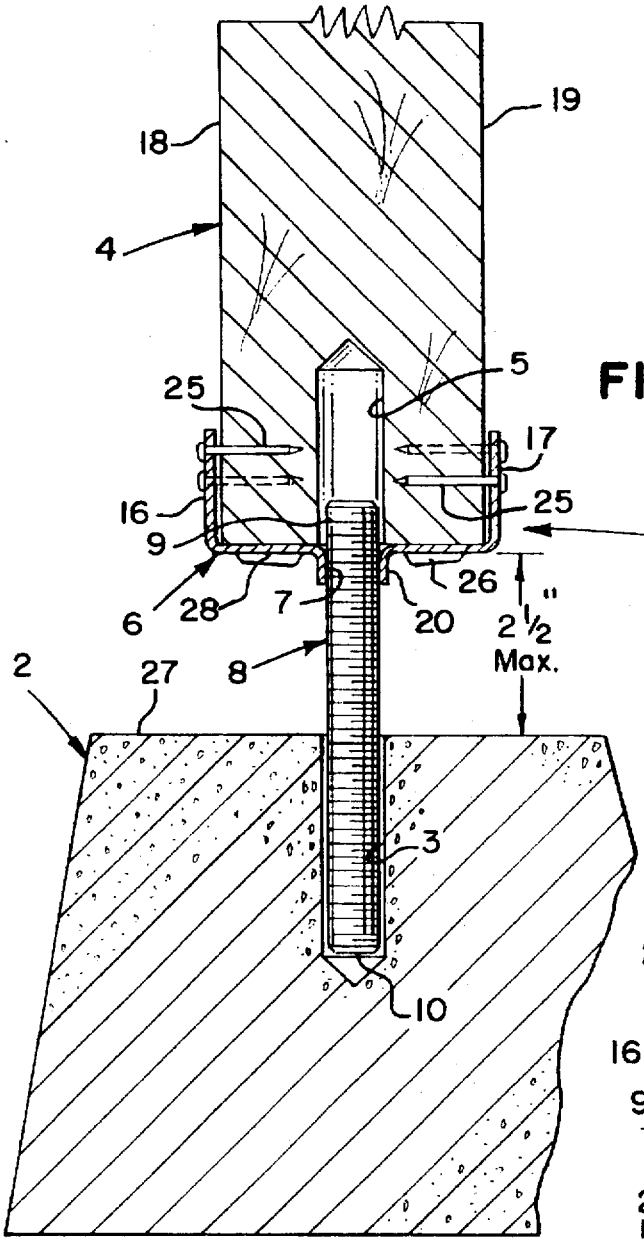
FIG. 5 is a cross sectional view of still another form of the invention. The view is similar to FIG. 4 which was taken along line 4—4 of FIG. 3.

Referring to FIG. 5, the installation is identical to the installation of the form of the invention illustrated in FIGS. 1 and 2 except that no epoxy or cement ground is used to anchor bolt 8 in aperture 3. In this form of the invention, the bolt may be set in the form and the concrete poured around the bolt 8, or if the bolt 8 is retrofitted, aperture 3 is drilled so that there is very little tolerance between the outside diameter of the bolt and the diameter of the aperture. Sheet metal base member 6 is threadably connected to bolt 8 as previously described.

Referring to FIG. 6, the adjustable support system shown may be installed in exactly the same manner as the adjustable support system described in FIGS. 1 and 2.

Referring to the adjustable support system illustrated in FIGS. 3 and 4 an aperture 3 is either formed in the concrete prior to curing, or an aperture is drilled in the cured concrete. An adjustment means such as an internally threaded nut is threaded onto elongated support member 8 such as a threaded bolt to approximately its final position. A washer 14 having a diameter larger than the diameter of aperture 3 is then placed between the nut and the top surface 27 of foundation or first structural member 2. The nut is then rotated with a wrench with or without the second structural member or post 4 installed on sheet metal base member 6 until the specified elevation is obtained. After second structural member or post 4 has been set on sheet metal base member 6, fasteners 25 are inserted through openings 24 into post 4.

In another form of the invention, not shown, the elongated support member or bolt 8 may be threadable inserted into an internally threaded sleeve (not shown). No nut 12 or washer 14 is needed. Adjustment is achieved by simply rotating the bolt 8 in relation to the internally threaded sleeve (not shown).

I claim:

1. An adjustable support assembly comprising:

a. a first structural member formed with an opening therein;

b. a second structural member spaced from said first structural member and formed with an opening therein in alignment with said opening in said first structural member;

c. a sheet metal base member positioned in engagement with said second structural member and formed with a drawn and threaded opening therethrough;

d. an elongated support member for adjusting the distance between said first and second structural members formed with threads at a first end threadably engaged with said threaded opening in said sheet metal base member and inserted into said opening in said second structural member and having a second end positioned in said opening in said first structural member;

e. securing means joining said elongated support member to said first structural member;

f. said securing means is an epoxy material;

g. said first structural member is formed from concrete; and h. said second structural member is formed from wood.

2. An adjustable support assembly as described in claim 1 comprising:

a. said sheet metal base member includes a pair of laterally disposed flanges engaging the sides of said second structural member.

3. An adjustable support assembly comprising:

a. a first structural member formed with an opening therein;

b. a second structural member spaced from said first structural member;

c. a sheet metal base member positioned in engagement with said second structural member and formed with a drawn and threaded opening therethrough;

d. an elongated support member for adjusting the distance between said first and second structural members formed with threads at a first end threadably engaged with said threaded opening in said sheet metal base member, and having a threaded other portion spaced from said threaded end and having a second end positioned in said opening in said first structural member;

e. adjustment means formed with a threaded opening therethrough in threadable engagement with said threaded other portion of said elongated support member and formed with means spanning said opening in said first structural member;

f. said first structural member is formed from concrete; and g. said second structural member is formed from wood.

4. An adjustable support assembly as described in claim 3 comprising:

a. said sheet metal base member includes a pair of laterally disposed flanges engaging the sides of said second structural member.

5. An adjustable support assembly in a building structure comprising:

a. a first structural member formed with an opening therein;

b. a second structural member spaced from said first structural member;

c. a sheet metal base member positioned in engagement with said second structural member and formed with a drawn and threaded opening therethrough;

d. an elongated support member for adjusting the distance between said first and second structural members formed with threads at a first end threadably engaged with said threaded opening in said sheet metal base member, and having a threaded other portion spaced from said threaded end and having a second end positioned in said opening in said first structural member;

e. adjustment means formed with a threaded opening therethrough threadably engaged with said threaded other portion of said elongated support member and including a spanning member spanning said opening in said first structural member; and f. said first and second structural members are formed from wood.

6. An adjustable support assembly in a building structure comprising:

a. a first structural member formed with an opening therein;

b. a second structural member spaced from said first structural member and formed with an opening therein in alignment with said opening in said first structural member;

c. a sheet metal base member positioned in engagement with said second structural member and formed with a drawn and threaded opening therethrough;

d. an elongated support member for adjusting the distance between said first and second structural members threaded at a first end threadably engaged with said threaded opening in said sheet metal base member and inserted into said opening in said second structural member and having a second end positioned in said opening in said first structural member;

e. securing means joining said elongated support member to said first structural member;

f. said securing means is an epoxy material; and g. said first and second structural members are formed from wood.

* * * * *